US012181261B2

(12) United States Patent
Sanchez et al.

(10) Patent No.: US 12,181,261 B2
(45) Date of Patent: Dec. 31, 2024

(54) AUTOMATED APPARATUS FOR STORING, TRANSPORTING, DISPENSING, AND ASSEMBLING WIRELESS INITIATION DEVICES CONFIGURABLE FOR INITIATING EXPLOSIVE MATERIAL COMPOSITIONS

(71) Applicant: Orica International Pte Ltd, Singapore (SG)

(72) Inventors: Francisco Sanchez, Aurora, CO (US); Tom Manney, Glendale, AZ (US); Chad Chaffin, Aurora, CO (US)

(73) Assignee: Orica International Pte Ltd, Singapore (SG)

( * ) Notice: Subject to any disclaimer, the term of this patent is extended or adjusted under 35 U.S.C. 154(b) by 0 days.

(21) Appl. No.: 17/771,411

(22) PCT Filed: Oct. 23, 2020

(86) PCT No.: PCT/SG2020/050609

§ 371 (c)(1),
(2) Date: Apr. 22, 2022

(87) PCT Pub. No.: WO2021/080514

PCT Pub. Date: Apr. 29, 2021

(65) Prior Publication Data

US 2022/0412713 A1 Dec. 29, 2022

Related U.S. Application Data

(60) Provisional application No. 62/924,716, filed on Oct. 23, 2019.

(51) Int. Cl.
*F42B 39/30* (2006.01)
*F42B 3/103* (2006.01)
(Continued)

(52) U.S. Cl.
CPC ..... *F42B 39/30* (2013.01); *F42B 3/103* (2013.01); *F42D 1/045* (2013.01); *F42D 1/10* (2013.01); *F42D 1/22* (2013.01)

(58) Field of Classification Search
CPC .. F42B 3/10; F42B 3/103; F42B 39/00; F42B 39/002; F42B 39/30; F42D 1/08; F42D 1/10; F42D 1/22
(Continued)

(56) References Cited

U.S. PATENT DOCUMENTS 1,599,078 A 9/1926 David
2,773,410 A 12/1956 Bishop
(Continued)

FOREIGN PATENT DOCUMENTS

EP 0690285 A1 1/1996
WO WO-2003042626 A1 5/2003
(Continued)

*Primary Examiner* — James S Bergin

(57) ABSTRACT

Disclosed is a magazine apparatus including a first magazine and a second magazine. The first magazine is configured for holding, carrying and dispensing first initiation device components. The second magazine is configured for holding, carrying and dispensing second initiation device components. The first magazine and the second magazine are configured to dispense the first initiation device components and the second initiation device components in a corresponding manner such that a dispensed one of the first initiation device components and a correspondingly dispensed one of the second initiation device components can be assembled together to form a structurally complete, unified initiation device for loading into a borehole.

18 Claims, 8 Drawing Sheets

(51) Int. Cl.
*F42D 1/045* (2006.01)
*F42D 1/10* (2006.01)
*F42D 1/22* (2006.01)

(58) Field of Classification Search
USPC ..... 102/313
See application file for complete search history.

(56) References Cited

U.S. PATENT DOCUMENTS

| | | | | |
|---|---|---|---|---|
| 2,999,460 | A | 9/1961 | Joseph et al. | |
| 3,104,584 | A * | 9/1963 | Donovan | E21D 20/028 86/20.15 |
| 3,334,403 | A | 8/1967 | Satoshi | |
| 3,376,785 | A | 4/1968 | Tore | |
| 3,931,763 | A | 1/1976 | Bluhm | |
| 4,040,329 | A * | 8/1977 | Ljungberg | F42D 1/10 86/20.15 |
| 4,138,923 | A | 2/1979 | Brosseau et al. | |
| 4,926,742 | A | 5/1990 | Ma et al. | |
| 8,117,956 | B2 | 2/2012 | Emde | |
| 8,485,083 | B1 | 7/2013 | Care | |
| 9,207,055 | B2 | 12/2015 | Halander et al. | |
| 9,664,470 | B2 | 5/2017 | No | |
| 10,113,843 | B2 | 10/2018 | Appleby et al. | |
| 11,473,892 | B2 | 10/2022 | Santos et al. | |
| 2005/0131655 | A1 | 6/2005 | Moolman et al. | |
| 2013/0098257 | A1 | 4/2013 | Goodridge et al. | |
| 2016/0231074 | A1 | 8/2016 | Mcdaniel et al. | |
| 2017/0356292 | A1 | 12/2017 | Wang et al. | |
| 2018/0106584 | A1 | 4/2018 | Santos et al. | |
| 2018/0231361 | A1 | 8/2018 | Wicks et al. | |
| 2022/0349692 | A1 | 11/2022 | Sanchez et al. | |
| 2023/0003498 | A1 * | 1/2023 | Pourcenoux | E21C 37/00 |

FOREIGN PATENT DOCUMENTS

| | | | |
|---|---|---|---|
| WO | WO-2006128257 | A1 | 12/2006 |
| WO | WO-2012149277 | A2 | 11/2012 |
| WO | WO-2017041830 | A1 | 3/2017 |
| WO | WO-2020000057 | A1 | 1/2020 |
| WO | WO-2021080513 | A1 | 4/2021 |
| WO | WO-2021080514 | A1 | 4/2021 |

* cited by examiner

AUTOMATED APPARATUS FOR STORING, TRANSPORTING, DISPENSING, AND ASSEMBLING WIRELESS INITIATION DEVICES CONFIGURABLE FOR INITIATING EXPLOSIVE MATERIAL COMPOSITIONS

CROSS-REFERENCE TO RELATED APPLICATIONS

This application is a U.S. national phase application of International Patent Application No. PCT/SG2020/050609, filed Oct. 23, 2020, which claims the benefit of priority to U.S. Provisional Application No. 62/924,716, filed Oct. 23, 2019, the contents of each of which are hereby incorporated herein by reference in their entirety.

TECHNICAL FIELD

Aspects of the present disclosure relate to a mechanized, mechanizable, automated, or automatable apparatus structured for holding, storing, carrying, transporting, dispensing, and assembling initiation devices that are configurable or configured for initiating explosive material compositions, such as explosives material compositions loaded into boreholes in association with commercial blasting operations.

BACKGROUND

Conventional magazine apparatuses used for carrying explosive initiation device components may be poorly suited for handling and dispensing explosive initiation device components or explosive initiation devices, e.g., in semi-automated, automated, or autonomous explosive loading systems.

It is desired to address or ameliorate one or more disadvantages or limitations associated with the prior art, or to at least provide a useful alternative.

SUMMARY

Disclosed herein is a magazine apparatus including:

- a first magazine (e.g., 100H) configured for holding, carrying and dispensing first initiation device components (e.g., 10); and
- a second magazine (e.g., 100B) configured for holding, carrying and dispensing second initiation device components (e.g., 50), wherein the first magazine and the second magazine are configured to dispense the first initiation device components and the second initiation device components in a corresponding manner such that a dispensed one of the first initiation device components and a correspondingly dispensed one of the second initiation device components can be assembled together to form a structurally complete, unified initiation device (e.g., 80) for loading into a borehole.

The first magazine may include a first carrier (e.g., 110H) for carrying the first initiation device components and for guiding the first initiation device components during dispensing, and the second magazine may include a second carrier (e.g., 110B) for carrying the second initiation device components and for guiding the second initiation device components during the dispensing.

Each of the first and second carrier may include at least one slot (e.g., 120H,B), and the slot may be configured to carry the first or second initiation device components across a middle portion of each initiation device component's length, and the at least one slot may include an inner or bottom surface (e.g., 125H,B) closer to a centroid or center point of the carrier, and each slot may include an exit opening (e.g., 124H,B) at outer edges (e.g., 114H,B) of the carriers.

The first magazine may include a set of first spiral guide structures (e.g., 300H) for carrying the first initiation device components and for guiding the first initiation device components during the dispensing, and the second magazine may include a set of second spiral guide structures (e.g., 300B) for carrying the second initiation device components and for guiding the second initiation device components during the dispensing.

The first and second spiral guide structures may be disposed relative to the corresponding first and second carriers for establishing or providing first and second spiral travel channels/paths (e.g., 342H,B) for the initiation device components held by the slots, and the spiral travel channels/paths may be configured for carrying the first and second initiation device components across at least one end portion of each initiation device component's length, such that rotation of the carrier relative to the spiral guide structures in a dispensing direction displaces the initiation device components along the spiral travel channels/paths and along the slots toward respective first and second outlets of the first and second magazines.

The magazine apparatus may include a first lid structure (e.g., 500H) for opening to allow loading of the first initiation device components into the first magazine, and including a second lid structure (e.g., 500B) for opening to allow loading of the second initiation device components into the second magazine.

The magazine apparatus may include a first case structure (e.g., 400H) for at least partially encasing the first carrier and the first spiral guide structures, and may include a second case structure (e.g., 400B) for at least partially encasing the second carrier and the second spiral guide structures, and the magazine apparatus may include a first explosives box enclosure (e.g., **700*h*) for enclosing the first case structure, and a second explosives box enclosure (e.g., 700*b***) for enclosing the second case structure.

The magazine apparatus may include a drive shaft for driving the first magazine and the second magazine to dispense the first initiation device components and the second initiation device components in the corresponding manner.

The first initiation device components in the first magazine or the second initiation device components in the second magazine may be wireless initiation device components.

The magazine apparatus may include a plurality of the first initiation device components in the first magazine, and a corresponding plurality of the second initiation device components in the second magazine.

The magazine apparatus may include an assembly apparatus configured for receiving or capturing and controllably securely joining or assembling one of the first initiation device components output or dispensed by the first magazine together with a corresponding one of the second initiation device components output or dispensed by the second magazine to form the initiation device. The magazine apparatus may include a first receiving compartment and a second receiving compartment, and the first and second magazines may include respective discharge apertures (e.g., 402H,B) with receiving and/or guiding structures such as funnel structures configured for smoothly and accurately delivering the first initiation device component into the first receiving compartment and the second initiation device component into the second receiving compartment. The assembly apparatus may align the first initiation device component with the second initiation device component in a manner that facilitates or enables their automated structural coupling or connection. The magazine apparatus may include a joining apparatus or device that may include at least one selectively displaceable pushing element, pushing structure, or pusher/plunger that is configured for causing or producing relative motion between the first initiation device component and the second initiation device component such that a distance between the first initiation device component and the second initiation device component progressively decreases until the first initiation device component and the second initiation device component structurally couple and securely join together, and the first initiation device component and the second initiation device component may have cooperatively alignable or aligned structural elements, e.g., snap-fit elements, that facilitate their secure coupling or attachment together. The magazine apparatus may include an assembled initiation device compartment, and a pushing device/element/structure/pusher to transfer the initiation device to the assembled initiation device compartment.

Disclosed herein is a vehicle including the magazine apparatus securely mountable or mounted to the vehicle for transport to a location near or at the borehole (e.g., 5*a*).

Disclosed herein is a method including:

holding a plurality of first initiation device components in a first magazine; and holding a plurality of second initiation device components in a second magazine;

dispensing from the first magazine one of the plurality of first initiation device components; and dispensing from the second magazine one of the plurality of second initiation device components in a corresponding manner to the dispensing of the first initiation device component, and optionally:

assembling the dispensed first initiation device component and the correspondingly dispensed second initiation device component together to form a structurally complete, unified initiation device;

loading the unified initiation device into a borehole;

displacing the plurality of first initiation device components in the first magazine (along spiral travel channels/paths and along slots) toward a first outlet of the first magazine; and/or displacing the plurality of second initiation device components (50) in the second magazine (along spiral travel channels/paths and along slots) toward a second outlet of the second magazine.

Disclosed herein is an assembly apparatus configured for receiving or capturing and controllably securely joining or assembling one of the first initiation device components output or dispensed by the first magazine together with a corresponding one of the second initiation device components output or dispensed by the second magazine to form an initiation device.

Disclosed herein is a method including:

receiving a first initiation device component;

receiving a second initiation device component in a corresponding manner to the receiving of the first initiation device component; and assembling the dispensed first initiation device component and the correspondingly dispensed second initiation device component together to form a structurally complete, unified initiation device.

The apparatus and the method are for holding, storing, carrying, transporting, dispensing, and assembling portions of initiation devices that are configurable or configured for initiating explosive material compositions, such as explosives material compositions loaded into boreholes in association with commercial blasting operations.

BRIEF DESCRIPTION OF THE DRAWINGS

Some embodiments of the present invention are hereinafter described, by way of non-limiting example only, with reference to the accompanying drawings, in which.

DETAILED DESCRIPTION

Figure 1:
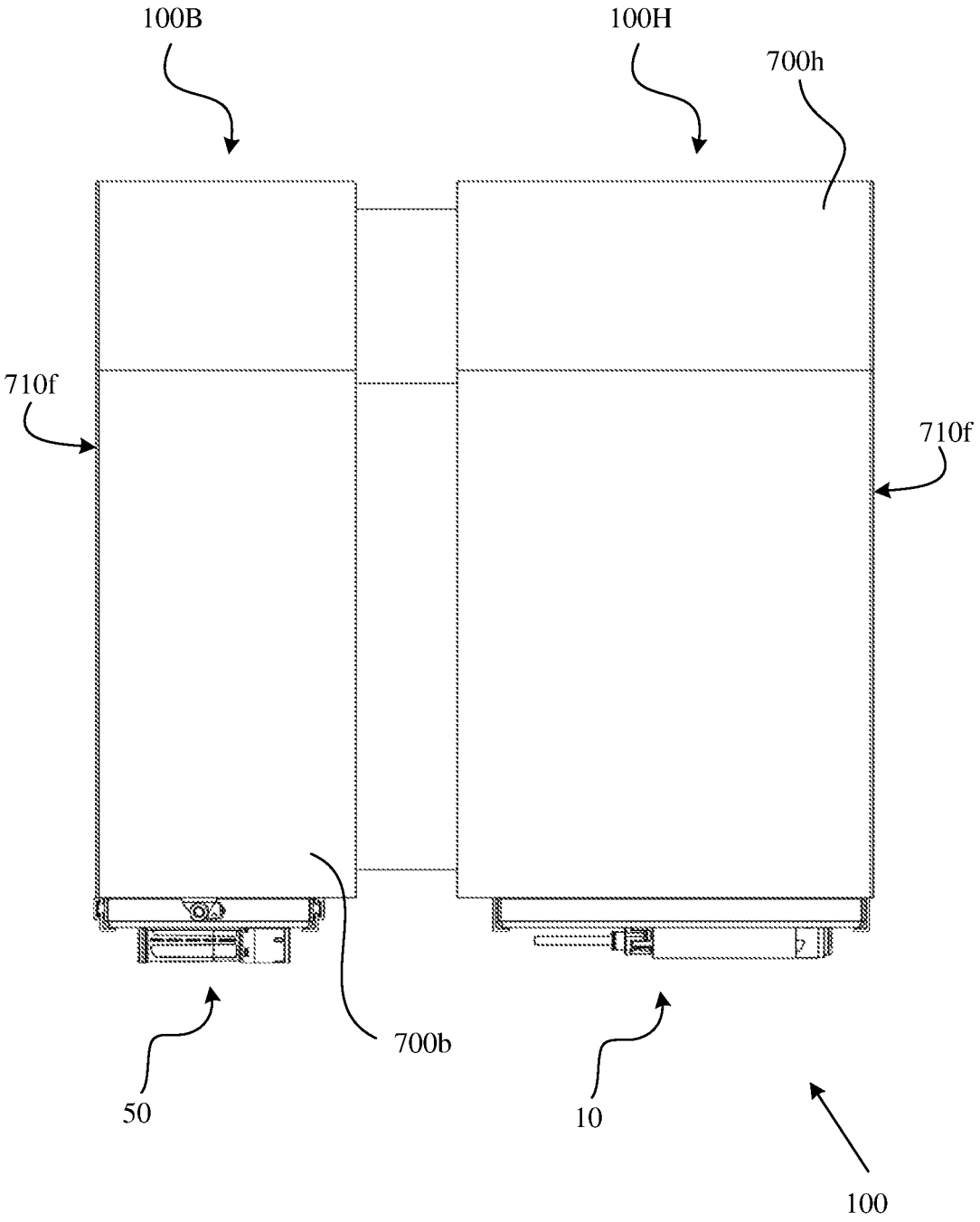
FIG. 1 is a diagram of a magazine apparatus disclosed herein.

In this specification, unless the context stipulates or requires otherwise, any use of the word "comprise," and variations thereof such as "comprises" or "comprising," imply the inclusion of a stated element or operation or group of elements or operations, but not the exclusion of any other element or operation or group of elements or operations.

The reference in this specification to any prior publication (or information derived from it), or to any matter which is known, is not, and should not be taken as an acknowledgment or admission or any form of suggestion that prior publication (or information derived from it) or known matter forms part of the common general knowledge in the field of endeavor to which this specification relates.

As used herein, the term "set" corresponds to or is defined as a non-empty finite organization of elements that mathematically exhibits a cardinality of at least 1 (i.e., a set as defined herein can correspond to a unit, singlet, or single element set, or a multiple element set), in accordance with known mathematical definitions (for instance, in a manner corresponding to that described in An Introduction to Mathematical Reasoning: Numbers, Sets, and Functions, "Chapter 11: Properties of Finite Sets" (e.g., as indicated on p. 140), by Peter J. Eccles, Cambridge University Press (1998)). Thus, a set includes at least one element. In general, an element of a set can include or be one or more portions of a system, an apparatus, a device, a structure, an object, a process, a physical parameter, or a value depending upon the type of set under consideration.

Herein, reference to one or more embodiments, e.g., as various embodiments, many embodiments, several embodiments, multiple embodiments, some embodiments, certain embodiments, particular embodiments, specific embodiments, or a number of embodiments, need not or does not mean or imply all embodiments.

The FIGS. included herewith show aspects of non-limiting representative embodiments in accordance with the present disclosure, and particular elements shown in the FIGS. may be representative in nature, in that they are not shown to scale or precisely to scale relative to each other, and/or can be implemented in different or multiple manners. The depiction of a given element or consideration or use of a particular element number in a particular FIG. or a reference thereto in corresponding descriptive material can encompass the same, an equivalent, an analogous, categorically analogous, or similar element or element number identified in another FIG. or descriptive material associated therewith. The presence of "I" in a FIG. or text herein is understood to mean "and/or" unless otherwise indicated. The recitation of a particular numerical value or value range herein is understood to include or be a recitation of an approximate numerical value or value range, for instance, within +/−20%, +/−15%, +/−10%, +/−5%, +/−2.5%, +/−2%, +/−1%, +/−0.5%, or +/−0%. The term "essentially" or "essentially all" can indicate a percentage, or within a percentage, greater than or equal to 90%, for instance, 92.5%, 95%, 97.5%, 99%, or 100%.

Overview

Embodiments in accordance with the present disclosure are directed to an apparatus or set of apparatuses by which initiation devices (including wireless initiation devices, partially/partly wireless or partially/partly wired initiation devices and wired initiation devices) that are configurable or configured for initiating explosive material compositions (e.g., tertiary explosive material compositions such as ammonium nitrate (AN) based emulsion explosives and/or other types of bulk tertiary explosive material compositions) employed in commercial blasting operations can be stored or transported; output, released, dispensed, or ejected; and assembled, e.g., in support of borehole loading procedures or operations in which boreholes drilled in a geological formation are loaded with one or more types of explosive material compositions as well as initiation devices (wireless and wired) configurable or configured for initiating such explosive material compositions. The apparatus configured for storing or transporting and outputting, releasing, dispensing, or ejecting the initiation devices can be referred to as a (wireless or wired) initiation device magazine apparatus; and an apparatus configured for assembling (wireless or wired) initiation devices can be referred to as a (wireless or wired) initiation device assembly apparatus.

A wireless initiation device can communicate by way of low frequency or very low frequency signals that can propagate through the earth (TTE) over distances to a blast control system (or blasting machine) that enable one or more types of commercial blasting operations (e.g., surface/open cut mining blasting operations, and/or underground mining blasting operations). A partially/partly wireless or partially/partly wired initiation device can include a top box or collar component that is connected by one or more wires to the down-hole component that includes the detonator/initiation element and primer explosive, and the top box can be configured to communicate by way of RF frequency communications, e.g., according to standard protocols, using RF signals that propagate through the air to the blasting machine for similar commercial blasting operations. For purpose of brevity and clarity, partially/partly wireless or partially/partly wired initiation devices are encompassed herein by the terms wireless initiation devices or wired initiation devices. A wired initiation device can communicate by way of one or more wires, e.g., a harness, over distances to the blasting machine that enable one or more types of commercial blasting operations (e.g., surface/open cut mining blasting operations, and/or underground mining blasting operations). An initiation device can include at least two components, namely, a first or head unit, which includes a communication/control unit (which itself is configured respectively for wireless or wired communications with a blasting operation system) that is coupled or couplable to an initiation device (e.g., a detonator); and a second or booster unit, which carries an explosive booster charge that the initiation device is configured to initiate. In some wired initiation devices, the head unit may be referred to as a "detonator assembly". In both wireless initiation devices and wired initiation devices, the detonator can be included in either the head unit or the booster unit, e.g., incorporated or affixed to the respective unit forming one piece for storage and assembly. Once a head unit and the booster unit are coupled or securely joined together to form a structurally complete or unified initiation device, e.g., which can be defined as an explosive primer unit, a primer unit, an explosive primer, or a primer, the initiation device can be encoded, e.g., such that it is functional/operational, and loaded into a borehole. A representative example of a wireless initiation device configured for MI based communication is a WebGen® initiation device available from Orica International Pte Ltd, Singapore, as described in U.S. Patent Publication No. 20180231361, entitled "Wireless Initiation Device," filed in the USPTO on 16 Mar. 2018. A properly encoded/fully functional initiation device can receive instructions/commands from remotely located blast control equipment, e.g., a blast control system, and process and selectively execute such instructions/commands in association with facilitating or enabling a commercial blasting operation. In response to a specific instruction/command or instruction/command sequence (e.g., a FIRE command, or a FIRE command in association with a prior command that established a delay time), a set of initiation devices can be activated to explosively initiate one or more types of explosive material compositions surrounding or proximate or adjacent to the initiation device(s).

A (wireless or wired) initiation device magazine apparatus, which for purpose of simplicity and clarity can be referred to herein as a magazine apparatus or magazine, in accordance with embodiments of present disclosure is movable, portable, or transportable/trammable, e.g., typically securely mountable or mounted to a piece of equipment or a vehicle that supports or performs borehole loading procedures, and transportable/trammable by the equipment or vehicle to a location near or at which borehole loading with explosive material compositions and initiation devices is intended to occur. As disclosed herein, it can be beneficial to (a) reduce or minimize (i) the number of moving parts in a magazine apparatus in order to reduce structural complexity, reduce cost, and enhance mechanical reliability or the magazine apparatus, and/or (ii) the mass of the magazine apparatus in order to aid the transportability thereof, while also maintaining an intended, practical, or adequate (b) level of structural integrity of the magazine apparatus as well as (c) total initiation device carrying capacity within the magazine apparatus. Initiation device magazine apparatuses in accordance with the present disclosure may provide or realize at least some of such benefits.

In several embodiments, a magazine apparatus configured for carrying and dispensing the initiation devices includes or resides in an enclosure that is constructed in a manner that meets regional or national requirements set forth by one or more countries for explosives day boxes and/or carry boxes. Thus, the initiation device magazine apparatus in accordance with an embodiment of the present disclosure can also be referred to or defined as or reside in a (wireless or wired) initiation device day box and/or carry box.

The initiation device assembly apparatus in accordance with embodiments of the present disclosure can receive a head unit and a corresponding booster unit from an initiation device magazine apparatus, and automatically assemble or securely join the head unit and the booster unit to form a structurally complete or unified initiation device, e.g., which has a structure shown and described in U.S. Patent Publication No. 20180231361. For purpose of simplicity and clarity, the initiation device assembly apparatus can be referred to herein as an assembly apparatus, assembly unit, or assembler.

Aspects of a Magazine Apparatus

FIG. 1 is a schematic illustration of a (wireless or wired) initiation device magazine apparatus or magazine ("dual magazine") 100 configured for carrying/holding and dispensing initiation devices 80 in accordance with an embodiment of the present disclosure. The magazine apparatus 100 includes a first apparatus that can be defined as an initiation device head unit magazine apparatus or magazine 100H; and a second apparatus, which can be defined as an initiation device booster unit magazine apparatus or magazine 100B. The head unit magazine 100H is configured for holding/carrying and dispensing first initiation device components, which can be initiation device head units 10; and the booster unit magazine 100B is configured for holding/carrying and dispensing second initiation device components, which can be initiation device booster units 50, such that a given first initiation device component (initiation device head unit 10) output or dispensed by the magazine apparatus 100 and a given second initiation device component (initiation device booster unit 50) output or dispensed by the magazine apparatus 100 can be assembled together by way of an assembly apparatus, such as detailed below, to form a given structurally complete or unified initiation device 80, which can be a wireless initiation device.

In various embodiments, an initiation device head unit 10 has an overall or maximum length, and an overall or maximum cross sectional area or diameter; an initiation device booster unit 50 has an overall or maximum length, and an overall or maximum cross sectional area or diameter; and when assembled an initiation device 80 has an overall or maximum length, and an overall or maximum cross sectional area or diameter. A portion of the initiation device head unit 10, e.g., the initiation device or element (e.g., a detonator) thereof, can be insertable into a passage of the initiation device booster unit 50 when the initiation device 80 is assembled, in a manner understood by individuals having ordinary skill in the relevant art. Alternatively, a portion of the initiation device booster unit 50, e.g., the initiation element (e.g., detonator) thereof, can be insertable into a passage of the initiation device head unit 10 when the initiation device 80 is assembled.

In various portions of the text herein and particular FIGS. included herewith, a suffix "h" or "H" applied or appended to a given element reference number indicates an element of the head unit magazine 100H; and a suffix "b" or "B" applied or appended to this element reference number indicates a corresponding or counterpart element of the booster unit magazine 100B. Notwithstanding, in various embodiments, the head unit magazine 100H and the booster unit magazine 100B each internally include or internally consist essentially of essentially the same or the same types and/or numbers of structural elements, but the shape(s), size(s), and/or dimension(s) of particular structural elements typically differs between the head unit magazine 100H and the booster unit magazine 100B because of mass, shape, size, and/or dimensional differences between each head unit 10 and each booster unit 50. Hence, portions of the description hereafter are directed to fundamental structural aspects of both the head unit magazine 100H and the booster unit magazine 100B. Individuals having ordinary skill in the relevant art will understand the manner(s) in which the shape(s), size(s), and/or dimension(s) structural elements of the head unit magazine 100H and the booster unit magazine 100B can be provided, formed, and/or implemented in view of the following description.

Figure 2A:
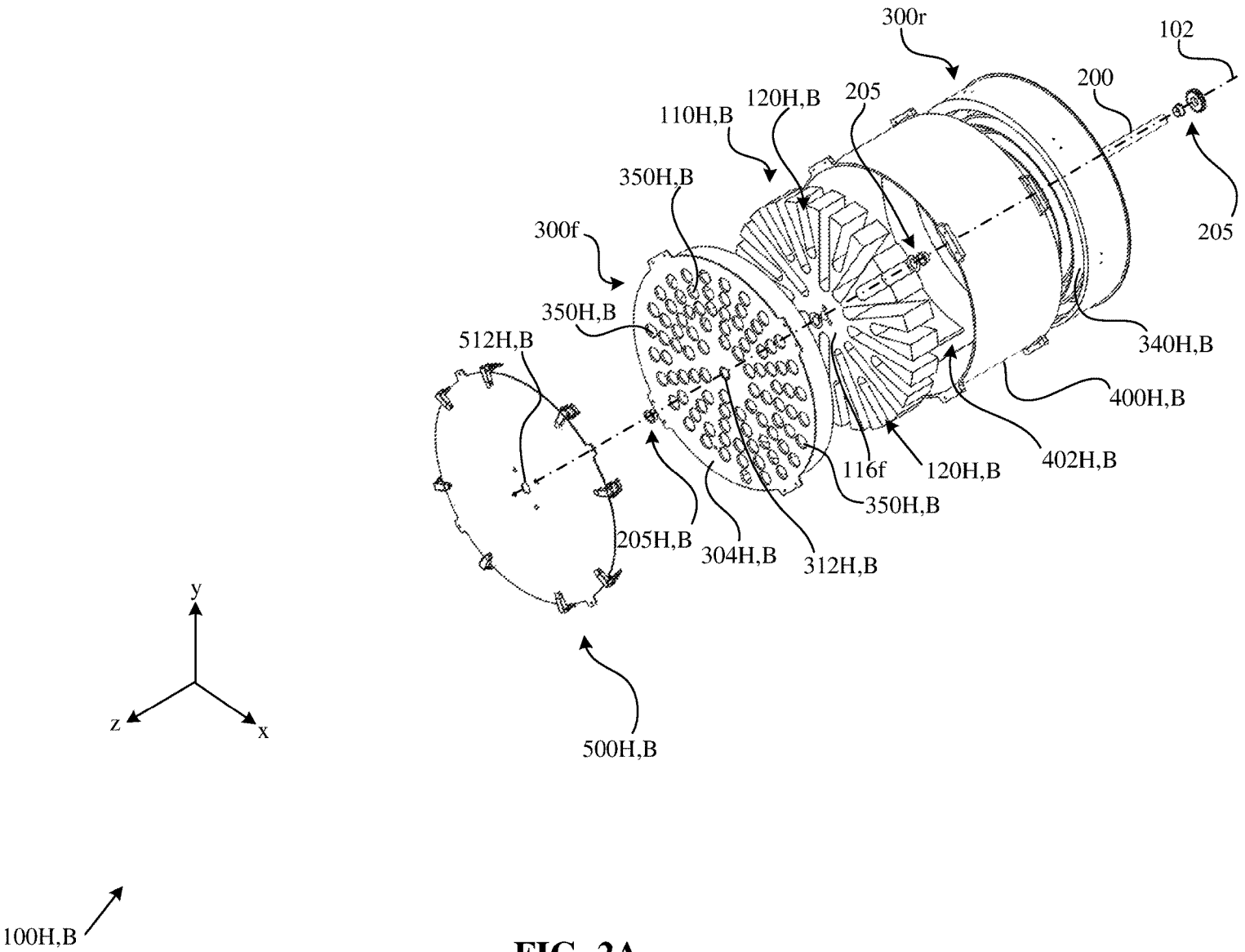
FIG. 2A is an exploded-view diagram of a magazine of the magazine apparatus.
Figure 2B:
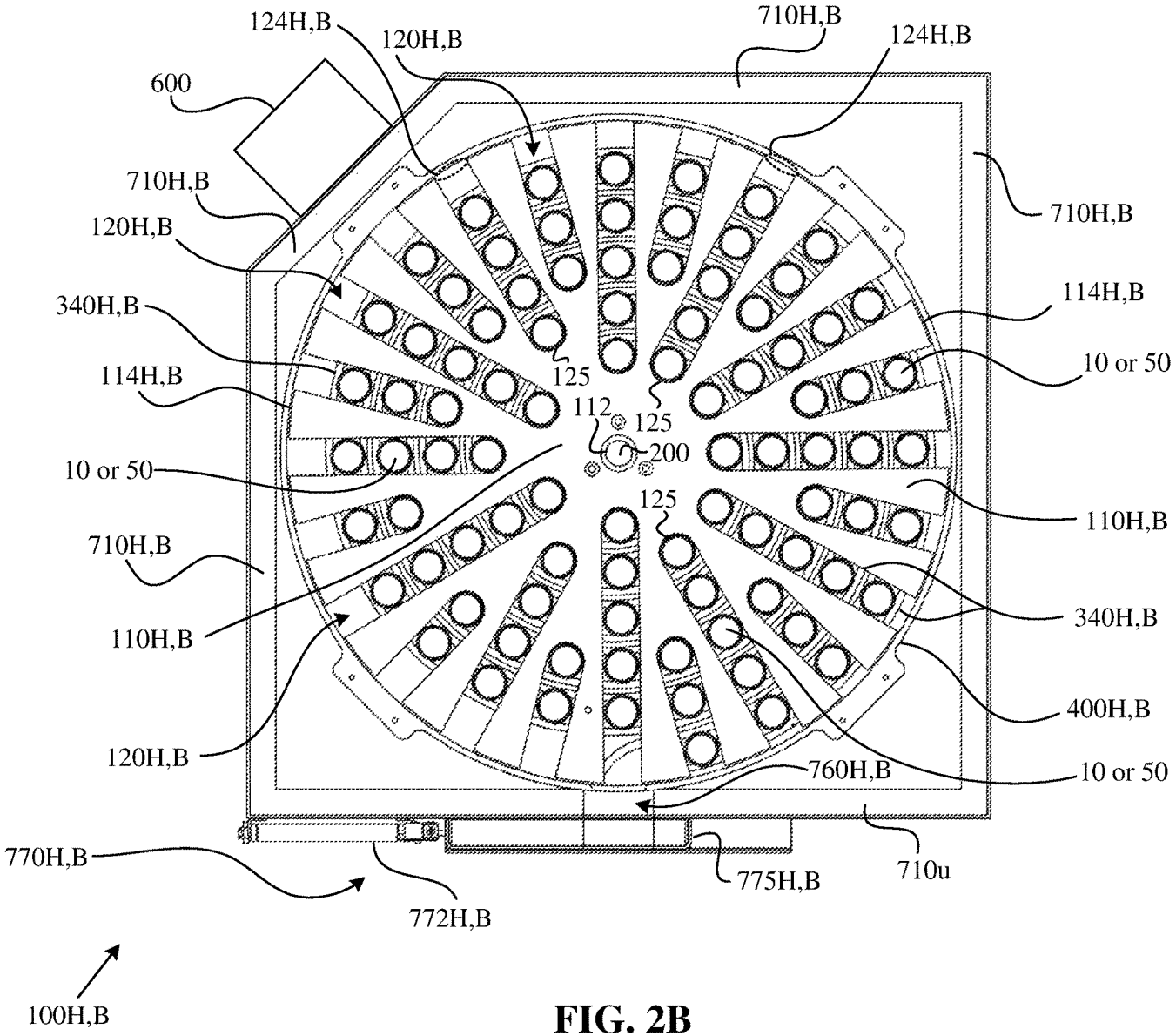
FIG. 2B is an end-view diagram of the magazine.

FIG. 2A is an exploded perspective view of a magazine apparatus or magazine 100H,B in accordance with several embodiments of the present disclosure. FIG. 2B is a front view of a magazine assembly or magazine 100H,B in accordance with multiple embodiments of the present disclosure, which is loaded with initiation device head units 10 or initiation device booster units 50 depending upon whether the magazine 100H,B is a head unit magazine 100H or a booster unit magazine 100B, respectively.

The magazine apparatus 100 has a central or longitudinal axis 102, relative to which multiple structural elements of the magazine apparatus 100 are cooperatively alignable or aligned. The central axis 102 of the magazine apparatus 100 can be defined to be parallel to or extend along a spatial z axis corresponding to a coordinate system defined by orthogonal x, y, and z axes, in a manner understood by individuals having ordinary skill in the relevant art.

In multiple embodiments, the magazine 100H,B includes or internally consists essentially of the following structural elements, e.g., when assembled and/or in use:

1. a carrier 110H,B for carrying the (first, second) initiation device components and for guiding the (first, second) initiation device components during dispensing;
2. a drive shaft 200 for driving the magazine 100H,B to carry and dispense the (first, second) initiation device components;
3. a set of spiral guide structure(s) 300H,B for carrying the (first, second) initiation device components and for guiding the (first, second) initiation device components during dispensing in cooperation with the carrier 110H,B;
4. a case structure 400H,B for at least partially encasing the carrier 110H,B and the spiral guide structure(s) 300H,B;
5. a removable or detachable lid structure 500H,B for opening to allow loading of the (first, second) initiation device components into the carrier 110H,B and spiral guide structure(s) 300H,B;
6. a drive mechanism with a motor 600 for rotating the drive shaft 200; and
7. an explosives box enclosure 700*h,b* for enclosing the case structure 400H,B according to explosives day box/carry box requirements.

1. Displaceable/Rotatable Carrier 110H,B

A displaceable/rotatable carrier 110H,B exhibits a disk-like or cylindrical spatial profile, geometry, or shape, and includes a plurality of elongate recesses, channels, or slots 120H,B formed therein across its disk-like spatial profile.

Each slot 120 H,B has an elongate length (or "depth") across portions of the cross-sectional area of the carrier 110H,B, e.g., from an outer or outward boundary or aperture 124H,B of the slot 120H,B corresponding to a portion of an outer edge 114H,B of the carrier 110H,B, to an inner or bottom surface 125H,B of the slot 120H,B closer to a centroid or center point of the carrier 110H,B. Along its depth, each slot 120H,B is configured for carrying and holding or retaining each of a set of initiation devices 10 across a particular portion of the initiation device's length, wherein the particular portion is a middle portion between longitudinal ends of the initiation device. As shown in FIG. 2B, the slots 120H,B have includes slots with mutually different depths: e.g., including a first slot depth holding 5 units in the slot 120H,B, a second slot depth holding 4 units in the slot 120H,B, a third slot depth holding 3 units in the slot 120H,B; and a fourth slot depth holding 2 units in the slot 120H,B. The shallower slots are arranged between pairs of the deeper slots as shown in FIG. 2B.

The carrier 110H,B may be described as a "carrier plate" or "carrier wheel" because it has an axial thickness substantially less than its diameter, e.g., like a wagon wheel. This axial thickness is essentially equal to the particular portion of the initiation device's length.

More particularly, in various embodiments the carrier 110H,B has a generally planar, approximately planar, or planar first, forward, or front exposed surface 116*f* that is parallel to a first spatial plane, e.g., an x-y plane corresponding to orthogonal x and y spatial axes; and a generally planar, approximately planar, or planar second, rearward, rear, or back exposed surface that is also parallel to the first spatial plane. The carrier 110H,B has a thickness corresponding to or defined by a distance between its front exposed surface 116*f* and its rear exposed surface 116*r*, e.g., along the spatial z axis. The carrier 110H,B has a predetermined diameter or span across the cross-sectional area of the front and/or rear exposed surfaces 116*f,r*. The carrier 110H,B also has a central opening 112H,B therein, within which the center point of the carrier 110H,B resides such that the carrier's center point is aligned with the central axis of the magazine 100H,B, parallel to the z axis. The carrier 110H,B is rotatable, e.g., in a clockwise and/or a counterclockwise direction, about the magazine's central axis 102.

Further with respect to the aforementioned slots 120H,B, each slot 120H,B has a length or depth that extends in a direction parallel to the first spatial plane and transverse or perpendicular to the magazine's central axis 102. More specifically, the depth of each slot 120H,B extends along a radial direction with respect to the magazine's central axis 102, from a slot exit opening or aperture 124H,B corresponding to a particular portion of the outer edge 114H,B of the carrier 110H,B, to a slot bottom surface 125H,B located a predetermined distance away from the magazine's central axis 102. Each slot 120H,B has a thickness that extends across or through the carrier's thickness, e.g., the thickness of each slot 120H,B corresponds to or equals the thickness of the carrier 110H,B. The axial thickness of the slot 120H,B is sufficient to carry the middle portion. Furthermore, each slot 120H,B has a width parallel to the first spatial plane, which is slightly larger than an outer cross-sectional area or diameter (e.g., a maximum outer cross-sectional area or diameter) of a portion, section, or segment of an initiation device component, e.g., an initiation device head unit 10 or an initiation device booster unit 50, that the slot 120H,B is configured for holding. Each slot 120H,B thus prevents lateral movement(s) or displacement(s) of the initiation device components held by the slot 120H,B beyond the width of the slot 120H,B.

A given slot 120H,B is typically configured for carrying and holding or retaining multiple initiation device components along the slot's depth. In various embodiments, the slots 120H,B do not all have identical depths; that is, some slots 120H,B have a larger or a smaller depth than other slots 120H,B. In such embodiments, while the exit opening 124H,B of each of the slots 120H,B is located essentially the same or the same radial distance away from the magazine's central axis 102, and extends to the outer edge 114H,B of the carrier 110H,B, the bottom surfaces 125H,B of some slots 120H,B are radially closer to the magazine's central axis 102 than the bottom surfaces 125H,B of other slots 120H,B. Hence, when all slots 120H,B are fully loaded with initiation device components, some slots 120H,B can carry and retain or hold more initiation device components than other slots 120H,B. Additionally, the slots 120H,B need not be or are not all evenly spaced relative to each other about the circumference of the carrier. More particularly, in view of the foregoing the slots 120H,B can be cut into or formed in the carrier 110H,B in a manner that maximizes the number of initiation devices 80 that the magazine 100H,B can carry, while minimizing the overall mass of the carrier 110H,B and simultaneously ensuring that the carrier 110H,B remains structurally robust or exhibits sufficient structural integrity, e.g., when the magazine 100H,B is carrying a full load of initiating devices 80 including while the carrier 110H,B is undergoing rotational motion.

2. Drive Shaft

An elongate drive shaft or shaft 200 extends through the carrier's central aperture 112H,B. The shaft 200 has a lengthwise or longitudinal axis that is coincident with the magazine's longitudinal axis 102. The shaft 200 is securely couplable, coupled, or attached to each carrier 110H,B, e.g., at and/or around the carrier's central aperture 112H,B, such that the shaft's longitudinal axis and the magazine's longitudinal axis 102 are aligned or coincident, and rotation of the shaft 200 about its longitudinal axis rotates each carrier 110H,B about the corresponding magazine's longitudinal axis 102. Hence, rotation of the shaft 200 rotates each carrier 110H,B.

3. Spiral Guide Structure(s)

A set of spiral guide structures 300H,B, which includes or consists essentially of a first or front spiral guide structure 300*f* disposed forward of, or in front and adjacent to the carrier's exposed front surface 116*f*, and a second or rear spiral guide structure 300*r* disposed rearward of or behind and adjacent to the carrier's exposed rear surface 116*r*, is configured for establishing or providing a spiral travel channel/path 342H,B for initiation device components held by the carrier's slots 120 as the carrier 110 is rotated, e.g., in response to rotation of the shaft 200. In various embodiments, the spiral guide structure(s) 300H,B need not or do(es) not rotate about the magazine's longitudinal axis 102, e.g., the spiral guide structure(s) remain stationary during carrier rotation.

Each set of spiral guide structures 300H,B is disposed or fixed relative to the corresponding carrier 110H,B such that the spiral guide structures 300H,B can rotate about their spiral axis relative to the corresponding carrier 110H,B, but such that the spiral guide structures 300H,B are fixed at a selected axial distance from the corresponding carrier 110H,B such that the spiral guide structures 300H,B cooperatively carry the initiation device components with the corresponding carrier 110H,B even as they rotate relatively, e.g., due to the motor 600 driving the carriers 110H,B to rotate.

Each spiral guide structure 300H,B has a centroid or center point that resides within a central opening or aperture 312H,B of the spiral guide structure 300H,B, where the spiral guide structure central opening 312H,B is cooperatively alignable or aligned with the carrier's central opening 112H,B, such that each magazine's longitudinal axis 102 and the longitudinal axis of the shaft 200 are coaligned with the central opening 312H,B.

Figure 2C:
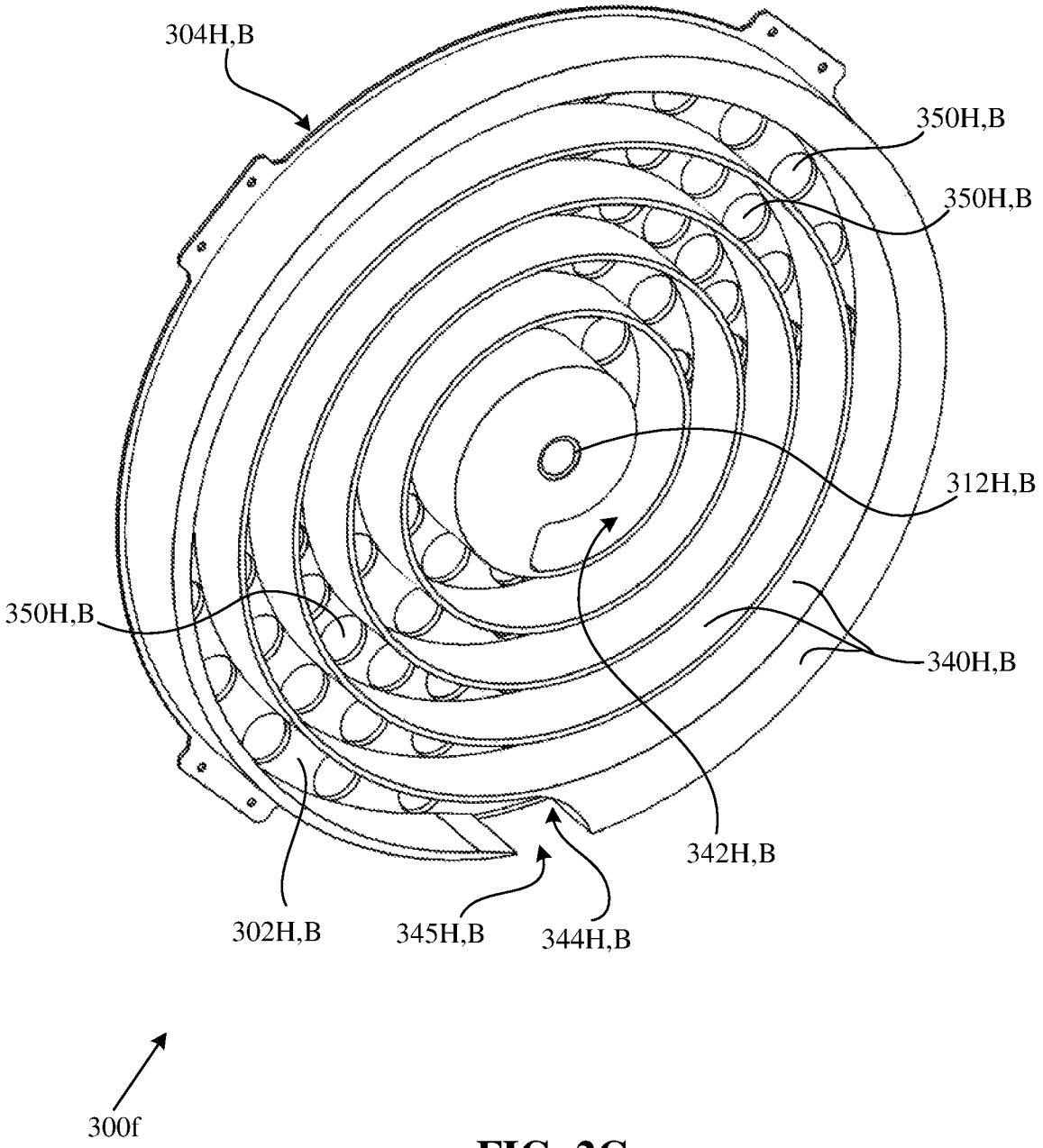
FIG. 2C is perspective view of a spiral guide structure of the magazine.

FIG. 2C is a perspective view of a front spiral guide structure 300*f* in accordance with an embodiment of the present disclosure, where this perspective view is taken along a direction from an underside 302H,B of the front spiral guide structure 300*f* toward a front or outer surface 304H,B of the spiral guide structure 300*f*.

With reference to FIGS. 2A and 2C, when the carrier 110H,B is rotated in an initiation component/device dispensing direction, the initiation device components, e.g., the initiation device head units 10 or the initiation device booster units 50, carried by the magazine 100H,B follow or are displaced (e.g., slidably displaced) along the spiral travel channel/path 342H,B in a progressive and/or indexed manner, which progressively moves the initiation devices components carried by the magazine 100H,B (a) around the magazine's longitudinal axis 102, and (b) radially outward away from the magazine's central axis 102. As a particular set of initiation device components held along the depth of a given slot 120H,B is rotatably displaced around the spiral travel channel/path 342H,B in the dispensing direction, each initiation device component held by the slot 120H,B is progressively displaced in a radially outward direction away from the magazine's longitudinal axis 102, toward the slot's exit aperture 124H,B.

More particularly with respect to the foregoing, each spiral guide structure 300*f,r* has a centroid or center point located within a central aperture opening 312H,B through which the shaft 200 can extend, and which is cooperatively aligned with the central opening 112H,B of the carrier 110H,B. Hence, each spiral guide structure 300*f,r* is cooperatively aligned with the carrier 110H,B. Each spiral guide structure 300*f,r* includes a spiral shaped support member 340H,B that projects perpendicular to the first spatial plane, e.g., along the spatial z axis, in a direction toward the carrier 110H,B. The spiral shaped support member 340H,B provided by the front spiral guide structure 300*f* provides or establishes a front spiral travel channel/path 342H,B; and the spiral shaped support member 340H,B provided by the rear spiral guide structure 300*r* provides or establishes a rear spiral travel channel/path 342H,B. The front and rear spiral guide structures 300*f,r* are cooperatively aligned relative to each other, with the carrier 110H,B disposed therebetween, such that initiation device components in the slots 120H,B can be smoothly displaced along a common or unified spiral travel channel/path 342H,B, corresponding to or defined as the cooperatively aligned front spiral travel channel/path 342H,B and rear spiral travel channel/path 342H,B, as the carrier 110 is rotated.

The magazine 100H,B includes axial separations between adjacent relatively rotating elements (i.e., the carrier 110H,B and its adjacent spiral guide structures 300*f,r*), including axial separations in the form of a front axial separation between the carrier 110H,B and the front spiral guide structure 300*f*, and a rear axial separation between the carrier 110H,B and the rear spiral guide structure 300*r*. These axial separations are sufficiently large keep the relatively rotating elements apart to avoid or mitigate interference between the adjacent elements which may undesirably cause friction, heating and/or damage, and/or may allow manufacturing of the rotating elements with lower tolerances. The axial separations are sufficiently small to avoid or mitigate the units 10,50 falling or dislodging into the axial separations. The axial separations may be between 1 mm and 20 mm, e.g., essentially 2 mm to 5 mm. The axial separation may be tapered, with a smaller axial separation closer to the axis and a larger axial separation further from the axis, e.g., to allow for larger axial movement or flexing of radially outer portions of the relatively rotating elements.

With respect to the particular (middle) portion of a given initiation device component, e.g., initiation device head unit 10 or initiation device booster unit 50, that is retained in a carrier slot 120H,B, a given spiral shaped support member 340H,B under consideration is configured for supporting another distinct portion of the initiation device component along the spiral travel channel/path 342H,B provided or established by the spiral shaped support member 340H,B, wherein the other distinct portion includes two end portions towards the opposed longitudinal ends of the initiation device. Thus the spiral travel channels/paths 342H,B are configured for carrying the first and second initiation device components across at least one end portion of each wireless initiation device component's length.

As indicated in FIG. 2C, the front spiral guide structure 300*f* includes a plurality of apertures or openings 350H,B in its front or outer surface 304H,B. More particularly, the front spiral guide structure 300*f* includes a plurality of openings 350H,B, which are arranged or disposed across the cross-sectional area of the front spiral guide structure 300*f* in a manner that corresponds or directly corresponds to the organization/pattern and depths of the slots 120H,B provided by the carrier 110H,B. For a head unit magazine 100H, initiation device head units 10 can be loaded or inserted into the head unit magazine 100H by way of insertion of the head units 10 into and through the apertures 350H of the head unit magazine's front spiral guide structure 300*f* into particular slots 120H of the head unit magazine's carrier 110H. Correspondingly, for a booster unit magazine 100B, initiation device booster units 50 can be loaded or inserted into the booster unit magazine 100B by way of insertion of the booster units 50 into and through the apertures 350B of the booster unit magazine's front spiral guide structure 300*f* and into particular slots 120B of the booster unit magazine's carrier 110B. Because in several embodiments the slots 120H,B do not all have the same depth and may not all be evenly or uniformly spaced apart from each other about the magazine's longitudinal axis 102, the carrier 110H of the head unit magazine 100H and that of the booster unit magazine 100B may need to be rotated to a loading position in order to load a maximum number of head units 10 into the head unit magazine 100H and booster units into the booster unit magazine 100B, respectively.

As indicated in FIG. 2C, the spiral shaped support member 340H,B includes an exit guide segment or section 344H,B proximal to a terminal end thereof, which directs or guides initiation device components to an outlet including an exit opening/aperture 345H,B of the front spiral guide structure 300*f* as they exit or are discharged from the spiral travel channel/path 342H,B.

4. Case Structure

A case structure 400H,B at least partially surrounds the carrier 110H,B and typically each spiral guide structure 300H,B, e.g., the carrier 110H,B and each of front and rear spiral guide structures 300*f,r* is at least partially encased by the cover structure 400H,B. The case structure 400H,B, which may be referred to as a "circular case" or "circular case structure", typically has an elliptical or circular cross-sectional area parallel to the aforementioned first spatial plane. The case structure 400H,B includes a portion of the outlet in the form of a discharge aperture 402H,B at a bottom portion thereof corresponding to the exit guide section 345H,B of each spiral shaped support member 340H,B.

Once an initiation device head unit 10 in a head unit magazine 100H or an initiation device booster unit 50 in a booster unit magazine 100B has been displaced around the spiral travel channel/path 342H,B in the head unit magazine 100H or booster unit magazine 100B, respectively, and has traveled along the spiral travel channel/path 342H,B and arrived at an outward-most radial distance away from the magazine's longitudinal axis 102 and is aligned with the case structure's discharge aperture 402H,B, it can exit the head unit magazine 100H or booster unit magazine 100B, further respectively, e.g., simply by way of the force of gravity acting thereon.

5. Removable/Detachable Lid Structure

Several embodiments additionally include a removable or detachable lid structure 500H,B, which can overlay the front spiral guide structure 300*f* for purpose of facilitating or enabling secure retention of the initiation device components carried in the magazine 100H,B. The lid structure 500H,B can be removably secured to portions of the cover structure 400H,B and/or the front spiral guide structure 300*f*, such as by way of fasteners (e.g., screws and/or secure latches), in a manner understood by individuals having ordinary skill in the relevant art. When the lid structure 500H,B is removed, initiation device components can be loaded into the magazine's slots 120H,B.

The lid structure 500H,B also has a centroid or center point that resides within a central opening or aperture 512H,B of the lid structure 500H,B, wherein the lid structure central opening 512H,B is cooperatively alignable or aligned with the carrier's central opening 112H,B.

6. Drive Mechanism(s)/Motor(s)

For a given magazine 100H,B, the shaft 200 thereof can be coupled to a drive mechanism including a motor 600, for instance, and a chain or belt coupled to the motor 600, in a manner understood by individuals having ordinary skill in the relevant art. Activation of the motor 600 rotates the shaft 200, which correspondingly rotates the carriers 110H,B, which correspondingly displaces the initiation device components disposed along the slots 120H,B around the unified spiral travel channels/paths 342H,B. Once a pair of given initiation device components arrives at the discharge apertures 402H,B, it can exit the magazines 100H,B by way of gravitational force acting on the component. Depending upon embodiment and/or situational details, the motor 600 can reside at any of multiple different locations on, corresponding to, or associated with the magazine apparatus 100 or equipment or a vehicle 7000 configured for transporting the magazine apparatus 100.

Figure 4:
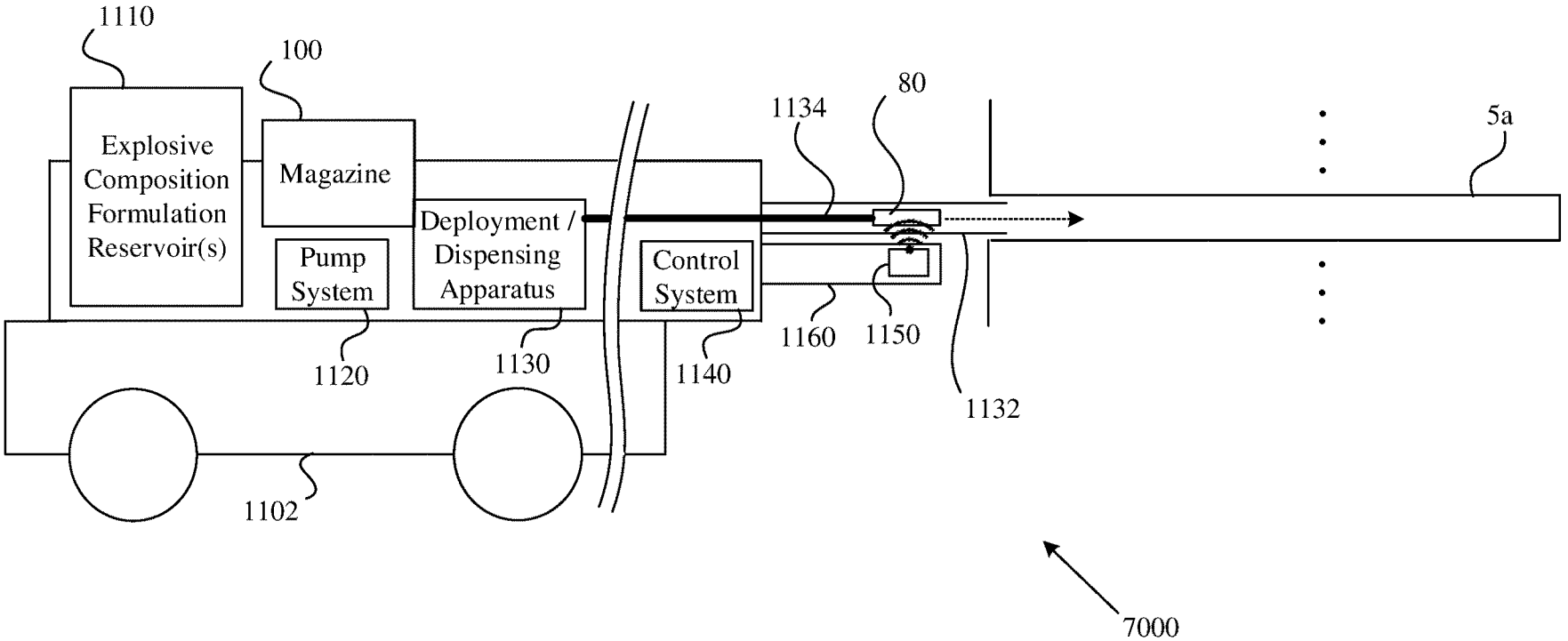
FIG. 4 is a diagram of a vehicle including the magazine apparatus and the associated assembly apparatus.

As shown in FIG. 4, the vehicle 7000 includes the magazine apparatus 100 and a mobile platform 1102 for carrying and moving the magazine apparatus 100. The magazine apparatus 100 is securely mountable or mounted to the vehicle 7000 for transport to a location near or at the borehole 5*a*, which may be essentially horizontal as shown in FIG. 4, or essentially vertical. As shown in FIG. 4, the vehicle 7000 may include: one or more explosive composition formulation reservoirs 1110; a pump system 1120 connected to the reservoirs 1110 for pumping the compositions into the borehole 5*a*; a deployment apparatus 1130, connected to the magazine apparatus 100, that is configured to receive the initiation device 80 from the magazine apparatus 100 (after its assembly in the magazine apparatus 100), and to deploying the initiation device 80 to an arm structure 1134 for loading; the arm structure 1134 configured to load the initiation device 80 from the deployment apparatus 1130 into the borehole 5*a*; and a control system 1140 for automatically controlling the magazine apparatus 100, the deployment apparatus 1130 and an encoder 1150 to provide the dispensing, the deployment and encoding (by the encoder 1150) of the initiation device 80. The vehicle 7000 includes a hollow pipe, tube or hose 1132 through which one or more explosive composition formulations can be pumped into the boreholes by the pump system 1120. For a wireless initiation device 80, the vehicle 7000 can include the encoder 1150 (mounted on a support arm 1160) that the wireless initiation device 80 passed when being automatically loaded into the borehole 5*a*, wherein the encoder 1150 is configured to communicate wirelessly with the wireless initiation device 80 to send commands and data for establishing or modifying an operational status or state of the wireless initiation device 80, e.g., including a delay time, such that the wireless initiation device 80 is configured to receive instructions/commands from the remotely located blast control equipment described hereinbefore, e.g., a FIRE command.

In view of the foregoing, it can be noted that the shaft 200 can extend through cooperatively aligned openings in each of the rear spiral guide structure 300*r*, the carriers 110H,B, the front spiral guide structure 300*f*, and possibly the removable lid structure 500H,B. The shaft can be supported within a given central opening by a bearing assembly 205, in a manner understood by individuals having ordinary skill in the relevant art.

Further in view of the foregoing, during magazine operation, e.g., in association with which initiation device components are displaced in a progressive and/or indexed manner along the spiral travel channel/path 342H,B and initiation device components are sequentially output or discharged from the magazine 100H,B, in several embodiments the only moving or rotationally displaced elements or parts of the magazine 100H,B internal to the case structure 400H,B are the shaft 200 and the carrier 110H,B coupled thereto. In such embodiments, while the carrier 110H,B is rotated by the shaft 200, each spiral guide structure 300H,B and the case structure 400H,B remain stationary relative to the rotational motion of the carrier 110H,B and the shaft 200. While the shaft 200 rotates the carrier 110H,B, the lid structure 500H,B typically also remains stationary with respect to the rotational motion of the carrier 110H,B and the shaft 200.

The drive mechanism may apply a torque of 1,000 oz-in to 100,000 oz-in to the shaft 200. The motor 600 may have a max torque for ramp up/start up of essentially 140 oz-in, and torque after ramp up of essentially 20 oz-in, and the motor 600 may include a 100:1 gearbox and a 3:1 pulley ratio, so the torque at the shaft 200 may be essentially 140*100*3=42,000 oz-in for ramp up, and essentially 20*100*3=6000 oz-in after ramp up.

7. Day Box/Carry Box Enclosure or Housing Structure

In various embodiments, a magazine apparatus or magazine 100H,B includes or resides in a day box/carry box enclosure structure or enclosure 700*h,b* (which may be referred to as a "box enclosure" or "explosives box enclosure"), e.g., a head unit magazine 100H includes or resides in a corresponding head unit magazine day box/carry box enclosure structure 700*h*, and a booster unit magazine 100B includes or resides in a corresponding booster unit magazine day box/carry box enclosure structure 700*b*. Each day box/carry box enclosure structure 700*h,b* is configured to meet regional and/or national requirements set forth by one or more states, multi-state regions, countries, and/or multi-country regions for explosives day boxes and/or carry boxes. The day box/carry box enclosure structure 700*h,b* includes a plurality of wall structures or walls 710H,B that surround the above-described elements of the magazine 100H,B, where each wall 710H,B is formed of one or more layers of material(s) and/or material compositions that satisfy such requirements for explosives day boxes/carry boxes.

The day box/carry box ("daybox") may include a 0.12 inch-thick stainless steel wall outside, ½ inch layer of A/C grade plywood inside, and a ½ inch layer of gypsum board (drywall) sandwiched between the inside and the outside, e.g., per IME SLP-22 (Institute of Makers of Explosives) requirements for a daybox.

A day box/carry box enclosure structure 700*h* can include an initiation device component discharge port 760H,B, e.g., along portions of an underside wall 710*u* thereof, e.g., which can be configured to interface with an assembly apparatus such as that described below. A day box/carry box enclosure structure 700*h* can include a mechanized or automated door device 770H,B having a door structure or door 775H,B configured to selectively open when an initiation device component is discharged or released from the magazine 100H,B, e.g., into the assembly apparatus, and which otherwise remains securely closed. Such a door device 770H,B can include or be coupled to a linear displacement mechanism 772H,B such as a linear actuator configured for selectively opening and closing the door 775H,B, in a manner understood by individuals having ordinary skill in the relevant art.

Each day box/carry box enclosure structure 700H,B typically includes a removable/openable wall structure 710H,B, such as a forward or front wall structure 710*f* that can be taken off of and/or swung away from the other wall structures 710H,B of the day box/carry box enclosure structure 700H,B, to enable access to the magazine's removable lid structure 500, such that initiation device components can be loaded into the magazine's slots 120H,B. The front wall structure 710*f* can be securely removably attached to a plurality of other wall structures 710H,B by way of fasteners (e.g., screws) and/or secure latches, in a manner understood by individuals having ordinary skill in the relevant art.

In view of the foregoing, an overall or complete magazine apparatus 100 configured for handling initiation device head units 10 and initiation device booster units 50 in accordance with an embodiment of the present disclosure includes a head unit magazine 100H and a booster unit magazine 100B, and hence includes a distinct carrier 110H,B; a distinct set of spiral guide structures 300H,B (e.g., a distinct front spiral guide structure 310*f* and a distinct rear spiral guide structure 300*r*); a distinct case structure 400H,B; a distinct removable lid structure 500H,B; and a distinct day box/carry box enclosure structure 700H,B corresponding to each of the head unit magazine 100H and the booster unit magazine 100H.

Aspects of an Assembly Apparatus

Figure 3:
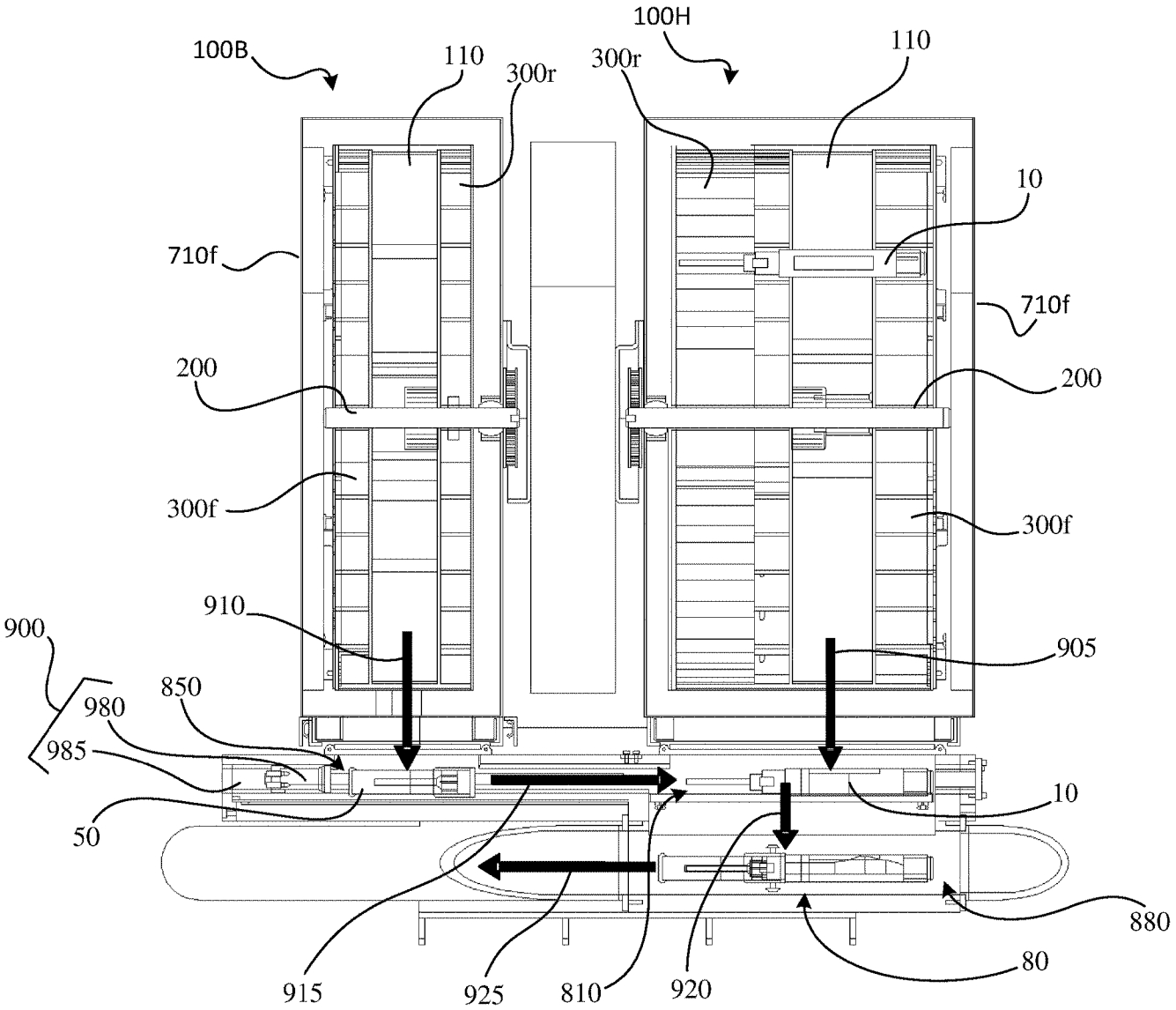
FIG. 3 is a side view cross-sectional diagram of the magazine apparatus interfaced with an associated assembly apparatus.

FIG. 3 is a cross-sectional illustration showing portions of a head unit magazine 100H, a booster unit magazine 100B, and an assembly apparatus 800 associated therewith according to an embodiment of the present disclosure. In an embodiment, the assembly apparatus includes an initiation device head unit compartment, or simply head unit compartment 810; an initiation device booster unit compartment, or simply booster unit compartment 850, which is cooperatively aligned with the head unit compartment 810; a mechanized or automated joining apparatus or device 900 configured for controllably securely joining or assembling a initiation device unit 10 located in the head unit compartment 810 together with an initiation device booster unit 50 located in the booster unit compartment 850; and an assembled initiation device compartment 880, into which an assembled or unified initiation device 80 can be transferred or reside such that it can be further transferred or conveyed to a borehole loading location.

More particularly, in an embodiment once an initiation device head unit 10 and a corresponding, complementary, or counterpart initiation device booster unit 50 have been output in a essentially downward direction 905,910 (by gravity) correspondingly (in a corresponding manner) from the head unit magazine's discharge aperture 402H and the booster unit magazine's discharge aperture 402B, where "correspondingly" or "corresponding manner" refers to a one-to-one correspondence, e.g., cooperatively, in a coordinated manner, together, in tandem, or approximately or essentially simultaneously as a pair of complementary initiation device components (i.e., one unit 10 and one unit 50), the head unit 10 and the booster unit 50 can be received or captured in the head unit receiving compartment 810 and the booster unit receiving compartment 850, respectively. The assembly apparatus 800 and/or each discharge aperture 402H,B can include receiving and/or guiding structures such as funnel structures configured for smoothly and accurately delivering the head unit 10 into the head unit receiving compartment 810 and the booster unit 50 into the booster unit receiving compartment 850.

In various embodiments, when a given head unit 10 and a given complementary or counterpart booster unit 50 reside in the head unit receiving compartment 810 and the booster unit receiving compartment 850, respectively, the head unit 10 and the booster unit 50 are inherently aligned or auto-aligned in a manner that facilitates or enables their automated structural coupling or connection, e.g., by virtue of the physical structure of such compartments 810, 850 and their spatial alignment and orientation relative to each other. For instance, the head unit 10 and the booster unit 50 can be inherently or automatically aligned, e.g., lengthwise aligned, relative to or along a common assembly axis when they reside in the head unit compartment 810 and the receiving unit compartment 850, respectively.

The joining apparatus or device 900 can include at least one selectively displaceable pushing element, pushing structure, or pusher/plunger 980 that is configured for causing or producing relative motion, e.g., in an essentially horizontal direction 915, between the head unit 10 and the booster unit 50 such that the distance between the head unit 10 and the booster unit 50 progressively decreases, until the head unit 10 and the booster unit 50 structurally couple and securely join together. The joining apparatus 900 can include a linear displacement mechanism 985, e.g., linear actuator device such as a ball screw or other type of linear displacement mechanism as will be understood by individuals having ordinary skill in the relevant art, configured for translating the pusher/plunger 980 in a manner that decreases the relative distance between the head unit 10 and the booster unit 50, e.g., by way of controllably pushing/displacing the booster unit 50 towards and to the head unit 10. The head unit 10 and the booster unit 50 can each have cooperatively alignable or aligned structural elements, e.g., snap-fit elements that facilitate their secure coupling or attachment together.

Once a given head unit 10 and a complementary booster unit 50 have been securely joined together to form an assembled, complete, or unified initiation device 80, e.g., a primer, the assembled initiation device 80 can be transferred to the assembled initiation device compartment 880 by way of another pushing device/element/structure/pusher, e.g., such as passage allowing a gravitational force in an essentially downward direction 920. The assembled initiation device 80 in the assembled initiation device compartment 880 can be released in an essentially horizontal direction 925 aligned with the longitudinal axis of the assembled initiation device 80.

Implementation of Magazine Apparatus

In an implementation, the magazine apparatus (or "dual magazine") 100 includes the head unit magazine 100H with the booster unit magazine 100B. The overall weight of the dual magazine 100 may be around 50 kg to 500 kg, e.g., essentially 300 kg. The capacity of the dual magazine 100 may be from essentially 10 units to 200 units, e.g., 90 units, i.e., 90 head units 10 and 90 respective booster units 50. The capacity of the dual magazine 100 can be increased by increasing the diameter of the magazines 100H,100B and while keeping the same slot width. The head unit 10 (referred to as a "DRX") may be essentially 300 mm long, including the length of the initiation element 20 of essentially 100 mm, with a maximum diameter of 34 mm. The booster unit 50 may be essentially 150 mm long, also with a maximum diameter of 34 mm. The head unit magazine 100H includes: the carrier 110 in the form of the head unit carrier 110H; the rear spiral guide structure 300*r* in the form of a head unit rear spiral guide structure; and the front spiral guide structure 300*f* in the form of a head unit front spiral guide structure. The booster unit magazine 100B includes: the carrier 110 in the form of a booster unit carrier 110B; and the rear spiral guide structure 300*r* in the form of a booster unit rear spiral guide structure; and the front spiral guide structure 300*f* in the form of a booster unit front spiral guide structure.

The head unit carrier 110H may be formed of a metal (e.g., aluminium/"aluminum"), and/or may weigh 5 kg to 100 kg, e.g., essentially 40 kg. The slots 120H on the head unit carrier 110H may be essentially 36 mm, i.e., around 2 mm larger than the maximum diameter of the head unit 10. The head unit rear spiral guide structure may be formed of a metal (e.g., aluminium), and/or may weigh 5 kg to 100 kg, e.g., essentially 40 kg. The head unit front spiral guide structure may be formed of a metal (e.g., aluminium), and/or may weigh 5 kg to 100 kg, e.g., essentially 14 kg. The booster unit carrier 100H may have the same dimensions as the head unit carrier 110H except it is axially thinner, with an (axial) thickness of 79 mm instead of 95.5 mm. The booster unit carrier 100B may be formed of a metal (e.g., aluminium), and/or may weigh 5 kg to 100 kg, e.g., essentially 30 kg. The slots 120 on the booster unit carrier 110B may be essentially 36 mm, i.e., around 2 mm larger than the maximum diameter of the booster unit 50. The booster unit rear spiral guide structure may be formed of a metal (e.g., aluminium), and/or may weigh 5 kg to 100 kg, e.g., essentially 10 kg. The booster unit front spiral guide structure may be formed of a metal (e.g., aluminium), and/or may weigh 5 kg to 100 kg, e.g., essentially 8 kg.

Method

Figure 5A:
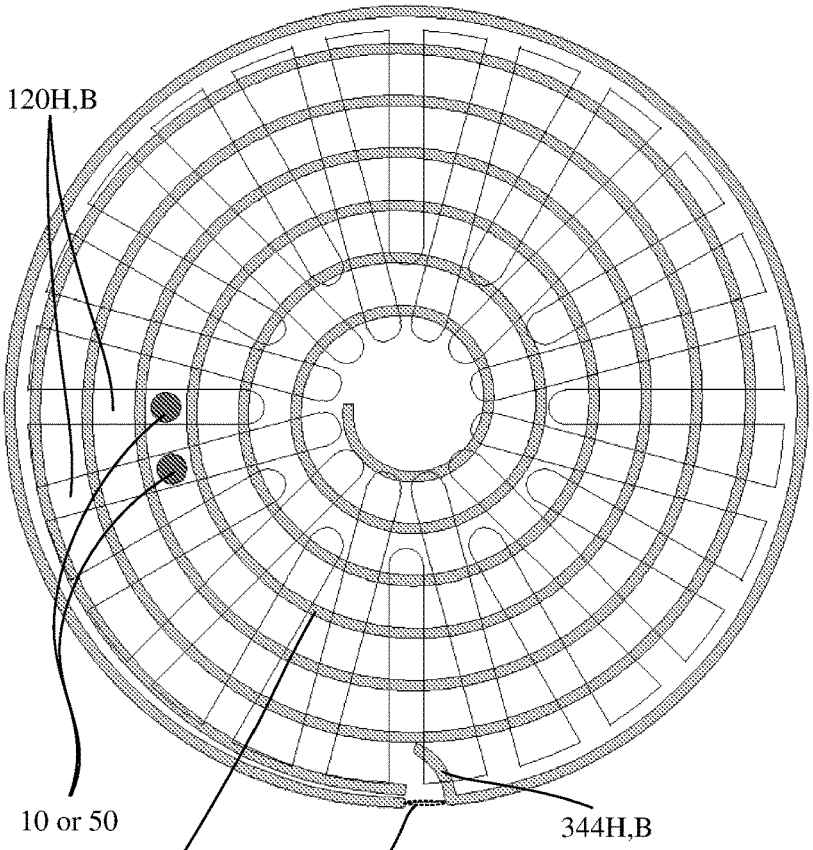
FIGS. 5A to 5C are end-view cross-sectional diagrams of two initiation device components being carried in the spiral guide structure towards an exit aperture.
Figure 5B:
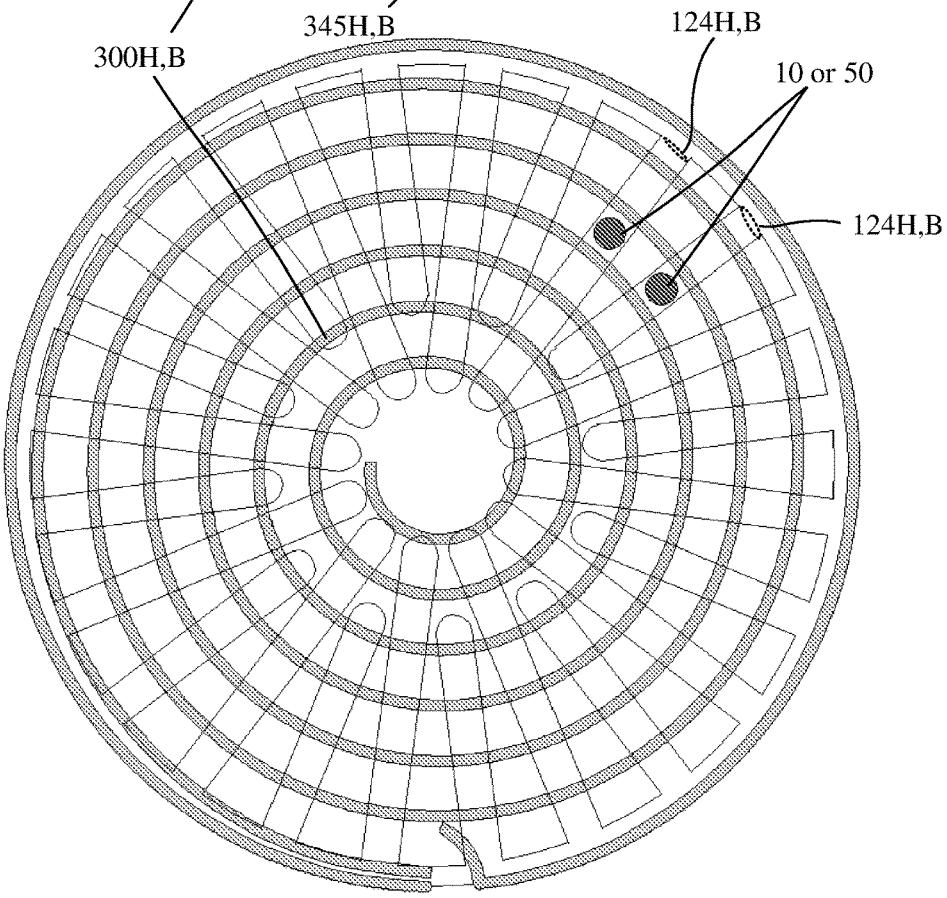
Figure 5C:
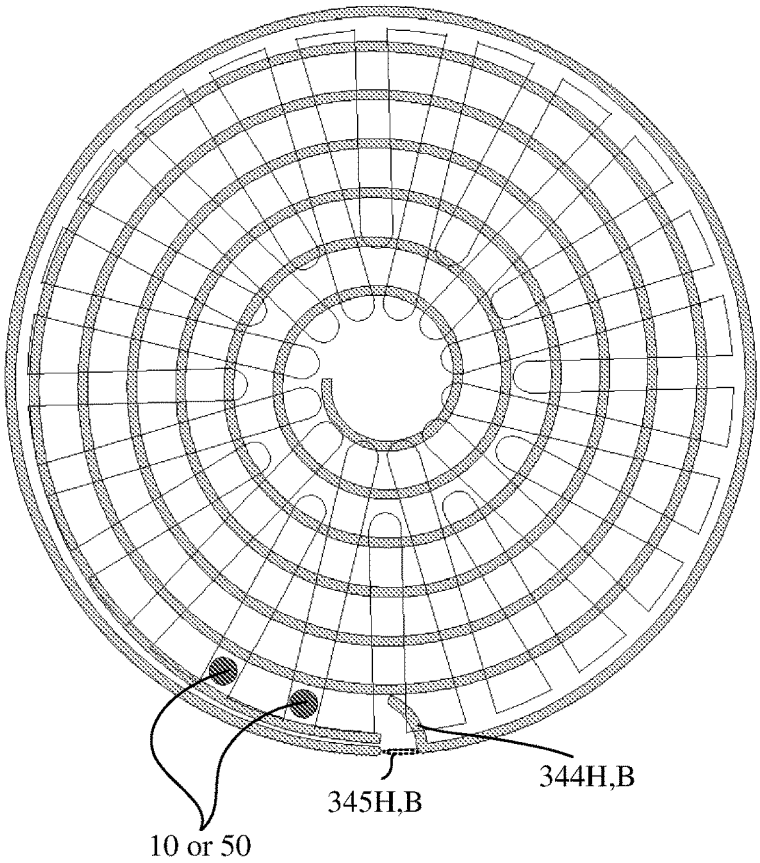
Figure 5D:
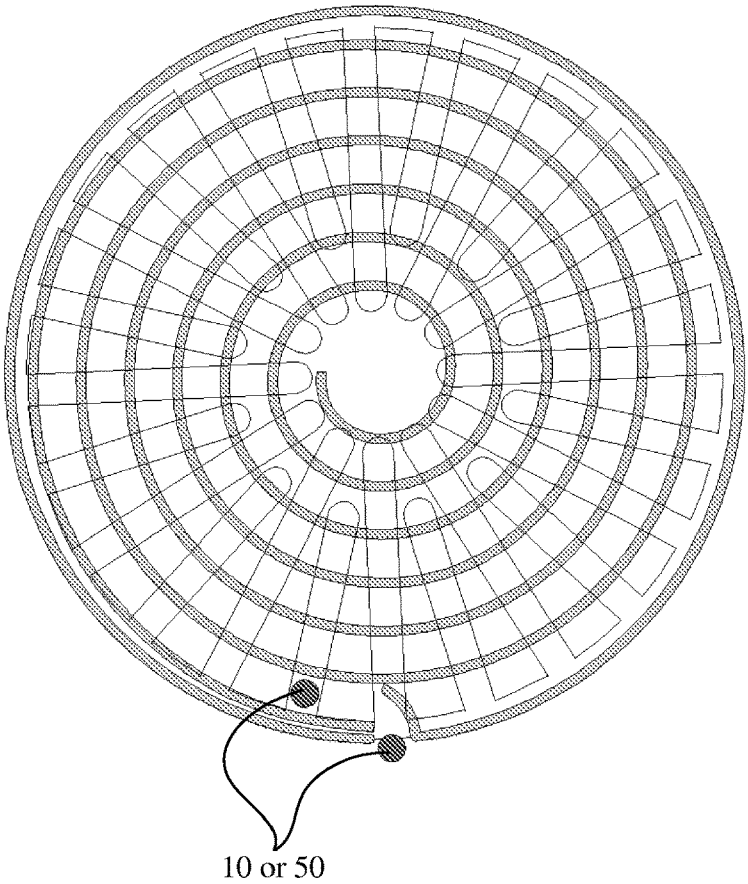
FIG. 5D is end-view cross-sectional diagram of one of the two initiation device components being dispensed from the exit aperture of the spiral guide structure in FIGS. 5A to 5C.

The magazine apparatus 100 provides a method of carrying and dispensing including:

receiving the plurality of first initiation device components 10 into a first magazine 100H;

receiving the plurality of second initiation device components 100 into the second magazine 100B, holding the plurality of first initiation device components 10 in the first magazine 100H, e.g., as illustrated in FIG. 5A;

holding the plurality of second initiation device components 100 in the second magazine 100B, e.g., as illustrated in FIG. 5A;

displacing the plurality of first and second initiation device components 10, 50 in the respective first and second magazines 100H,B—along the respective spiral travel channels/paths 342H,B and along respective the slots 120H,B, e.g., as illustrated in FIGS. 5A to 5C—toward the first and second outlets of the first and second magazines 100H,B; and dispensing from the first and second magazines 100H,B one of the plurality of first and second initiation device components 10,50, e.g., as illustrated in FIG. 5D, in a mutually corresponding manner.

The assembly apparatus 800 provides a method of assembly, including:

receiving the one of the first initiation device components 10;

receiving the one of the second initiation device components 50 in the corresponding manner to the receiving of the first initiation device component 10; and assembling the dispensed first initiation device component 10 and the correspondingly dispensed second initiation device component 50 together to form the structurally complete, unified initiation device 80.

The vehicle 7000 provides a method of deployment, including loading the unified initiation device 80 into the borehole 5*a*.

Interpretation

The above description details aspects of particular apparatuses and devices in accordance with particular non-limiting representative embodiments of the present disclosure. It will be readily understood by a person having ordinary skill in the relevant art that modifications can be made to one or more aspects or portions of these and related embodiments without departing from the scope of the present disclosure.

The invention claimed is:

1. A magazine apparatus including:

a first magazine configured for holding, carrying and dispensing first initiation device components; and a second magazine configured for holding, carrying and dispensing second initiation device components, wherein the first magazine and the second magazine are configured to dispense the first initiation device components and the second initiation device components in a corresponding manner such that a dispensed one of the first initiation device components and a correspondingly dispensed one of the second initiation device components can be assembled together to form a structurally complete, unified initiation device for loading into a borehole, wherein the magazine apparatus further includes an assembly apparatus configured for receiving or capturing and controllably securely joining or assembling the dispensed one of the first initiation device components and the correspondingly dispensed one of the second initiation device components to form the structurally complete, unified initiation device.

2. The magazine apparatus of claim 1, wherein the first magazine includes a first carrier for carrying the first initiation device components and for guiding the first initiation device components in the first magazine during the dispensing, and/or wherein the second magazine includes a second carrier for carrying the second initiation device components and for guiding the second initiation device components in the second magazine during the dispensing.

3. The magazine apparatus of claim 2, wherein the first and/or second carrier includes at least one slot, wherein the or each slot is configured to carry the first or second initiation device components across a middle portion of each initiation device component's length, wherein the or each slot includes an inner or bottom surface closer to a centroid or center point of the carrier, and wherein the or each slot includes an exit opening at an outer edges of the carriers.

4. The magazine apparatus of claim 3 wherein the first magazine includes a set of first spiral guide structures for carrying the first initiation device components and for guiding the first initiation device components during the dispensing, and/or wherein the second magazine includes a set of second spiral guide structures for carrying the second initiation device components and for guiding the second initiation device components during the dispensing.

5. The magazine apparatus of claim 4, wherein the first and/or second spiral guide structures are disposed relative to the corresponding first and/or second carriers for establishing or providing first and second spiral travel channels/paths for the initiation device components held by the slots, wherein the spiral travel channels/paths are configured for carrying the first and second initiation device components across at least one end portion of each initiation device component's length, such that rotation of the carrier relative to the spiral guide structures in a dispensing direction displaces the initiation device components along the spiral travel channels/paths and along the slots, in a progressive and/or indexed manner, toward respective first and/or second outlets of the first and second magazines.

6. The magazine apparatus of claim 4, including a first case structure for at least partially encasing the first carrier and the first spiral guide structures, and/or including a second case structure for at least partially encasing the second carrier and the second spiral guide structures.

7. The magazine apparatus of claim 6, further including a first explosives box enclosure for enclosing the first case structure, and/or a second explosives box enclosure for enclosing the second case structure.

8. The magazine apparatus of claim 1, including a first lid structure for opening to allow loading of the first initiation device components into the first magazine, and/or including a second lid structure for opening to allow loading of the second initiation device components into the second magazine.

9. The magazine apparatus of claim 1, including a drive shaft and a drive mechanism for driving the first magazine and/or the second magazine to dispense the first initiation device components and the second initiation device components in the corresponding manner.

10. The magazine apparatus of claim 1, wherein the first initiation device components in the first magazine or the second initiation device components in the second magazine are wireless initiation device components.

11. The magazine apparatus of claim 1, including a plurality of the first initiation device components in the first magazine, and including a corresponding plurality of the second initiation device components in the second magazine.

12. The magazine apparatus of claim 1, including a first receiving compartment and a second receiving compartment, wherein the first and second magazines include respective discharge apertures with receiving and/or guiding structures configured for smoothly and accurately delivering the first initiation device component into the first receiving compartment and the second initiation device component into the second receiving compartment.

13. A vehicle, including the magazine apparatus of claim 1 securely mountable or mounted to the vehicle for transport to a location near or at the borehole.

14. The magazine apparatus of claim 1, wherein the assembly apparatus aligns the first initiation device component with the second initiation device component in a manner that facilitates or enables their automated structural coupling or connection.

15. The magazine apparatus of claim 1, including a joining apparatus or device that includes at least one selectively displaceable pushing element, pushing structure, or pusher/plunger, that is configured for causing or producing relative motion between the first initiation device component and the second initiation device component such that a distance between the first initiation device component and the second initiation device component progressively decreases until the first initiation device component and the second initiation device component structurally couple and securely join together, wherein the first initiation device component and the second initiation device component have cooperatively alignable or aligned structural elements, snap-fit elements, that facilitate their secure coupling or attachment together.

16. The magazine apparatus of claim 1, including an assembled initiation device compartment, and a pushing device/element/structure/pusher to transfer the structurally complete, unified initiation device to the assembled initiation device compartment.

17. The magazine apparatus of claim 1, wherein the assembly apparatus includes a first receiving compartment and a second receiving compartment, wherein the first and second magazines include respective discharge apertures with receiving and/or guiding structures configured for delivering the first initiation device component into the first receiving compartment and the second initiation device component into the second receiving compartment.

18. The magazine apparatus of claim 1, wherein the first magazine and the second magazine are configured to dispense the first initiation device components and the second initiation device components into the assembly apparatus in the corresponding manner approximately or essentially simultaneously as a pair of complementary initiation device components.

* * * * *